United States Patent [19]

McCullough, Jr. et al.

[11] Patent Number: 4,857,404

[45] Date of Patent: Aug. 15, 1989

[54] FLUORINATED CARBONACEOUS FIBERS

[75] Inventors: Francis P. McCullough, Jr.; Leo J. Novak, both of Lake Jackson, Tex.

[73] Assignee: The Dow Chemical Company, Midland, Mich.

[21] Appl. No.: 236,478

[22] Filed: Aug. 24, 1988

[51] Int. Cl.[4] ..... B32B 9/00

[52] U.S. Cl. ..... 428/367; 428/369; 428/371; 428/373; 428/375; 428/378; 428/408; 428/420; 428/421; 428/902; 428/221

[58] Field of Search ..... 428/367, 371, 373, 375, 428/408, 420, 421, 902, 378, 221

*Primary Examiner*—James J. Bell

*Attorney, Agent, or Firm*—John Lezdey; Joe R. Prieto

[57] ABSTRACT

A fiber product comprising a core of a flexible, non-flammable carbonaceous polymeric fibers having an aspect ratio greater than 10:1, and a non-electrically conductive fluorinated surface.

12 Claims, 1 Drawing Sheet

FLUORINATED CARBONACEOUS FIBERS

FIELD OF THE INVENTION

This invention relates to novel carbonaceous fibers and the surface treatment of such fibers. More particularly, this invention relates to carbonaceous fibers having a fluorination treatment of their surface so as to protect the fibers against oxidation.

BACKGROUND OF THE INVENTION

It is known that the surface of fibers such as polyolefins, polyamides, polyesters, and polyacrylonitriles fibers can be fluorinated as described in U.S. Pat. Nos. 3,988,491 and 4,020,223.

U.S. Pat. No. 3,988,491, which is herein incorporated by reference, discloses that surface fluorination of polyamides and polyesters produces surface carboxylates. The fluorination is utilized to provide improved wicking.

U.S. Pat. No. 4,296,151 discloses the fluorination of polyolefins and copolymers of conjugated dienes and vinyl aromatic compounds to render the surfaces receptive to adhesion, inks, paints, and the like, by making the surfaces more polar in chemical nature.

The fluorination of carbonaceous fibers prior to the present invention has not been known.

U.S. Pat. No. 4,642,664 of Goldberg et al, which is herewith incorporated by reference, discloses the preparation of partially carbonized aromatic polyamides which may be used in the present invention.

U.S. patent application Ser. No. 112,353, filed Oct. 22, 1987, of McCullough et al, which is incorporated herein by reference, discloses a process for preparing carbonaceous fibers which may be utilized for preparing the fluorinated fibers of the invention.

It is desired to provide novel carbonaceous fibers with a fluorinated coating thereon. It is further desirable to provide protection of carbonaceous fibers against oxidation.

SUMMARY OF THE INVENTION

The present invention is directed to fibers or a fiber product comprising a core of a flexible, non-flammable carbonaceous fibers having their surfaces rendered non-electrically conductive and resistant to oxidation. The fibers of the invention may either be linear or non-linear in configuration or a combination of both.

The non-linear fibers advantageously have a reversible deflection ratio of greater than 1.2:1 and an aspect ratio (l/d) greater than 10:1. Advantageously they possess a coil-like or sinusoidal configuration or a combination of the two.

The fibers of the invention are substantially non-staining, non-soiling and non-wetting.

Therefore, it is an object of the invention to provide a carbonaceous fiber or fibrous structure which has been subjected to a fluorination treatment.

It is a further object of the invention to provide a carbonaceous fiber having an electrically conductive core and a non-electrically conductive surface.

It is a still further object of the invention to provide a non-linear carbonaceous fiber having shape-reforming characteristics and an outer surface resistant to nascent oxygen.

DETAILED DESCRIPTION OF THE PREFERRED EMBODIMENTS

In accordance with one embodiment of the invention, there is provided a fiber or fibrous structure comprising fluorinated, linear and/or non-linear non-flammable carbonaceous fibers. The non-linear fibers are elongatable and possess having a reversible deflection ratio of greater than about 1.2:1 and an aspect ratio (l/d) greater than 10:1. The carbonaceous fibers may possess a sinusoidal or coil-like configuration or a more complicated structural combination of the two.

Figure 1:
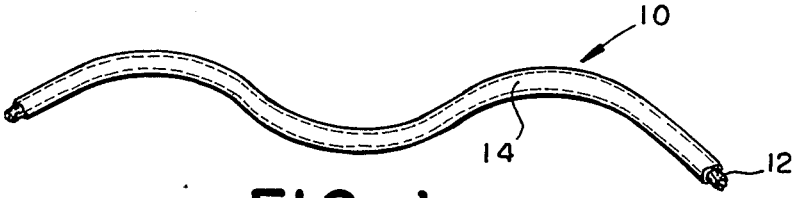
FIG. 1 is a perspective view of a filament of the invention with a sinusoidal configuration with a fluorinated surface coating.

As shown in FIG. 1, the fibers 10 of the invention may comprise a sinusoidal form wherein there is a fluorinated surface coating 14 and a fiber interior 12.

Figure 2:
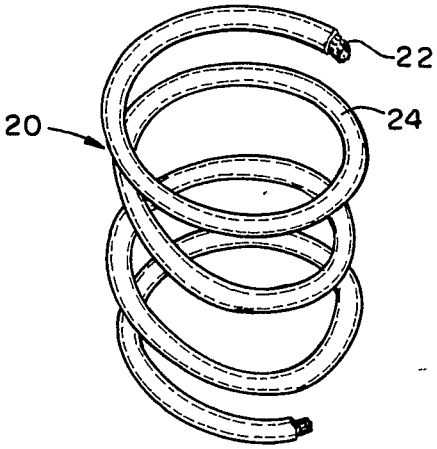
FIG. 2 is a perspective view of a filament of the invention with a coil-like configuration with a fluorinated surface coating.

FIG. 2 illustrates the fiber 20 in a coil-like configuration with a fluorinated surface coating 24 and a fiber interior 22. However, the fiber of the invention may comprise a mixture of the sinusoidal and coil-like configuration or a more complicated configuration.

Figure 3:
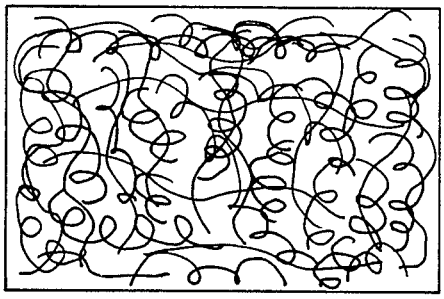
FIG. 3 is an enlarged view of a lightweight non-woven fibrous mat of the invention with a fluorinated surface coating.

FIG. 3 illustrates a non-woven mat comprising a mixture of fluorinated fibers in a thermoplastic matrix.

Such carbonaceous fibers are prepared by heat treating a suitable stabilized precursor polymeric material such as that derived from an assembly of stabilized aromatic polyamides, polyacrylonitrile based or pitch base (petroleum or coal tar) or other polymeric materials which can also be made into a sinusoidal or coil-like fiber or filament structures or more complicated configurations, and are thermally stable under conditions of the environment of use.

For example, in the case of polyacrylonitrile (PAN) fiber, fibers formed by melt or wet spinning a suitable fluid of the precursor material and having a normal nominal diameter of from about 6 to about 25 micrometers, collected as an assembly of a multiplicity of continuous filaments in tows are stabilized (by oxidation in the case of PAN) in the conventional manner. The stabilized tows (or staple yarn made from chopped or stretch broken fiber staple) may thereafter, in accordance with one feature of the present invention, be formed into a coil-like or sinusoidal form by knitting the tow or yarn into a fabric or cloth (recognizing that other fabric forming and coil forming methods can be employed).

The so-formed knitted fabric or cloth may thereafter be heat treated, in a relaxed and unstressed condition, at a temperature of from about 550 C. and about 750 degrees C., in an inert atmosphere for a period of time to produce a heat induced thermoset reaction wherein additional crosslinking and/or a cross-chain cyclization reaction occurs between the original polymer chain. At the lower temperature range of from 150 C. to about 525 C., the fibers are provided with a varying proportion of temporary to permanent set while in the upper range of temperatures of from 525 C. and above, the fibers are provided with a permanent set. It is of course to be understood that the fiber assembly may be initially heat treated at the higher range of temperatures so long as the heat treatment is conducted while the coil-like or sinusoidal configuration is in a relaxed unstressed state and under an inert, non-oxidizing atmosphere.

As a result of the higher temperature treatment, a permanent set coil-like or sinusoidal configuration or other set structure is imparted to the fibers in yarn, tow or threads. The resulting fibers, tow or yarn having the non-linear structural configuration derived by deknitting the cloth, or even the cloth per se is subjected to other methods of treatment known in the art to create an opening, a procedure in which the yarn, tow or the fibers or filaments of the cloth are separated into a non-linear entangled wool-like fluffy material in which the individual fibers retain their coil-like or sinusoidal configuration yielding a fluff or batting-like body of considerable loft.

The stabilized fibers when permanently configured in accordance with the present invention into the desired structural configuration, e.g., by knitting, and thereafter heating at a temperature of greater than about 550 C. retain their resilient and reversible deflection characteristics. It is to be understood that higher temperatures may be employed up to about 1500 C., but the most flexible and least loss of fiber length, when carded to produce the fluff, is found in those fibers and/or filaments heat treated to between about 525 C. and about 750 C.

The linear carbonaceous fibers may be prepared by heat treating fibers or filaments in a manner known in the art.

The carbonaceous materials which are utilized in the present invention may be classified in three groups depending upon the particular use and the environment that the structures in which they are incorporated are placed.

In the first group, the linear or non-linear carbonaceous fibers are non-electrically conductive and possess no anti-static characteristics. The fibrous batting after fluorination may be used in connection with clothing or sleeping blankets because of its excellent washability. The fibers may be blended with other synthetic or natural fibers including cotton, wool, polyester, polyolefin, nylon, rayon, and the like.

In a second group, the carbonaceous fibers are classified as having low electrically conductivity and are anti-static or static dissipating. These fibers have a carbon content of less than 85%. When the precursor stabilized fiber is polyacrylonitrile, the percentage nitrogen content is preferably, about 16 to about 20%. These particular fibers when fluorinated are excellent for use as insulation for aircraft and as insulation in areas where there is a build-up of electrical charges such as computers. The structures formed therefrom are lightweight, have low moisture absorbancy, good abrasive strength together with good appearance and handle.

As the third group are the fibers having a carbon content of at least 85%. The fibers as a result of their high carbon content have superior electrical conductivity. The fluorinated coil-like structure in the form of a fluff or when carded provides an insulation which has good compressability and resiliency while maintaining improved good electrical conductivity. The structure prepared with the third group of linear or non-linear fibers are particularly utilized in the insulation of furnaces and areas with structures placed in an atmosphere of oxidizing gases. Advantageously, there may be utilized in the electrically conductive fiber structures up to about 0.05% of the anti-static fibers.

The precursor stabilized acrylic filaments which are advantageously utilized in preparing the fibers of the structures are selected from the group consisting of acrylonitrile homopolymers and acrylonitrile copolymers. The copolymers preferably contain at least about 85 mole percent of acrylonitrile units and up to 15 mole percent of one or more monovinyl units copolymerized with styrene, methylacrylate, methyl methacrylate, vinyl chloride, vinylidene chloride, vinyl pyridine, and the like. Also, the acrylic filaments may comprise terpolymers.

It is to be further understood that carbonaceous precursor starting materials may have imparted to them an electrically conductive property on the order of that of metallic conductors by heating the fluff or the batting-like shaped material to above about 1000 C. The electroconductive property may be obtained from selected starting materials such as pitch (petroleum or coal tar), polyacetylene, polyacrylonitrile (PANOX or GRAFIL-01), polyphenylene, SARAN (Trademark), and the like.

The carbonaceous aromatic polyamide fibers and fibrous materials which may be utilized in the fluorination treatment according to the invention may be prepared according to the process described in the aforementioned U.S. Pat. No. 4,642,664. Among the precursor aromatic polyamide polymers which may be used in the invention there may be mentioned poly(p-phenylene terephthalamide), (2,7-(phenanthridone)terephthalamide), poly(paraphenylene-2,6-naphthalamide), poly(-methyl-1,4-phenylene)terephthalamide, and poly(-chloro-1,4-phenylene)terephthalamide. Additional specific examples of wholly aromatic polyamides are disclosed by P. W. Morgan in *Macromolecules,* Vol. 10, No. 6, pp. 1381–90 (1977), which is herein incorporated by reference in its entirety.

Preferred precursor materials are prepared by melt spinning or wet spinning in a manner to yield a monofilament or multi-filament fiber tow and the fibers or filaments thereof stabilized by oxidation and then converted into a yarn, tow woven cloth or fabric or knitted cloth by any of a number of commercially available techniques, heated preferably to above about 550 degrees C. and thereafter deknitted and carded to produce the fluff which can be laid up in batting-like form.

Once the fibers are obtained they can be used to produce various structure systems for example, a sheet-like material or web-like material of a carbon fiber matrix.

The surface of the carbonaceous fibers are fluorinated by any well known techniques such as described in U.S. Pat. Nos. 3,988,491 and 4,020,223.

In carrying out the fluorination process of the present invention, the carbonaceous fibers produced in accordance with the procedure outlined above are placed in a conventional reaction vessel. The reaction vessel is evacuated and fluorine gas preferably in an inert carrier gas is passed into the reactor to contact the carbonaceous fibers. When the reaction is complete the carbonaceous fibers are removed, washed with distilled water and dried. Treatment conditions are of course selected taking into account fiber size, fabric weave, count, etc.

In one embodiment of the invention, the temperature of the fluorination reaction is at ambient temperature. The amount of fluorine used is from about 0.1 to about 2.5 moles of fluorine per mole of carbon and typically about 1 mole fluorine per mole of carbon. The percent of fluorine in the inert gas used is from about 1 to about 75 percent and typically about 20% of fluorine. The reaction time may take from about 5 minutes to about 1 hour and typically about 1 hour. However, it is understood that the reaction time will vary with the concentration of the fluorine in the gas mixture.

Some of the applications in which the fluorinated carbonaceous fiber can be used include a conductor, for example, for use in motor windings, under carpets; in duct work; as a non-electrically conductive fiber web to be blended with other textiles or plastic materials, to absorb radiation such as microwaves; in electrodes and as the active ingredient for an "even cooking" microwave oven dish.

The following Examples illustrate embodiments of this invention. It is to be understood, however, that these are for illustrative purposes only and do not purport to be wholly definitive as to condition and scope for preferred practice of the invention.

EXAMPLE 1

The carbonaceous fibers were produced as follows:

A web material with 1½ inch and 6 inch cut of tow using PANOX material (knitted) which had been heat treated at 550 C. to 650 C. (and 950 C. for the 6" tow) was made. The material was separated into a fiber web using a Shirley Lab Trash Analyzer in the ASTM Cotton Lab at the Textile Engineering Dept at Auburn University.

A sample of the 650 C. web made at Auburn University using the Shirley machine had a fiber length of about 1½ inches long. Two samples were fluorinated. One sample had a high fluorine treatment and another sample had a low fluorine treatment. Both samples were checked for conductivity using a Techtronics DVM System. Neither sample showed any measurable conductivity. This in contrast to the original web material which has R less than 1 Meg ohms. The web empirically no longer seemed to be a good thermal insulator via the web on top on hand test and had a slightly darker back appearance compared to the original web material. Otherwise, the strength, flexibility and other bulk fiber properties appeared unchanged. The question was whether the interior of each fiber was conductive. To test this some of the fluorinated fiber web was placed in a microwave oven. The web was inside a styrofoam cup. The microwave oven was switched on and the cup melted where the fibers were in contact and some sparking was observed. This is in contrast to an empty styrofoam cup which showed no interaction with the microwaves of similar test conditions. This indicated that a non-conductive coating on the fiber can be obtained without affecting the good bulk properties of the fiber.

The carbonaceous fibers produced in accordance with the procedure outlined above were placed in a monel reaction vessel. The reaction vessel was evacuated and fluorine gas diluted in helium gas was allowed to flow into the reactor. When the reaction was complete, the carbonaceous fibers were removed, washed with distilled water and dried.

The amount of fluorine used was from about 0.1 to about 2.5 moles of fluorine per mole of carbon and typically about 1 mole of fluorine per mole of carbon. The percent of fluorine in the helium used was from about 1 to about 75 percent and typically about 20% fluorine. The reaction time took from about 5 minutes to about 1 hour and typically about 1 hour.

In lieu of fibers prepared from acrylic fibers there may be used any carbonaceous fiber including carbonaceous polyamides.

EXAMPLE 2

Samples of continuous oxidized PAN fiber tow are obtained having tow fiber counts of 3K, 6K, and 12K respectively. The tow lengths are 100 to 500 feet.

Each of the above samples of tow are knitted into cloth with 4 to 15 stitches/inch used depending on the tow size (4 for 12K, 15 for 3K).

Each knitted fabric is divided into three parts and heat treated at 550, 650 and 950 C. in a nitrogen atmosphere for 3 hours.

The resulting heat treated knitted cloth samples are then removed from the oven and the flexible elastic tows are removed as continuous tows using standard textile deknitting techniques.

The resulting conductive flexible/elastic fiber tows are then placed in a dilute fluorine stream reactor as described in Example 1 to fluorinate the samples at 20 to 200 C. for 1–15 minutes. This puts an electrically non-conductive coating around each fiber of the tow. The ends of each tow are preplated with copper to serve as electrical connector points for the finished cable.

The resulting flexible cables are ready to be installed under carpet or other office coverings.

What is claimed is:

1. A fiber product comprising a core of a flexible, non-flammable carbonaceous polymeric fibers having an aspect ratio greater than 10:1 and a reversible deflection ratio of greater than 1.2:1, and a non-electrically conductive fluorinated surface.

2. The fiber product of claim 1 wherein said fibers are non-linear and has a reversible deflection ratio greater than 1.2:1.

3. The fiber product of claim 2 wherein the fibers have a sinusoidal configuration.

4. The fiber product of claim 2 wherein the fibers have a coil-like configuration.

5. The fiber product of claim 1 which is derived from acrylic based fibers.

6. The fiber product of claim 1 wherein said carbonaceous fibers have static dissipating characteristics.

7. The fiber product of claim 1 wherein said carbonaceous fibers are electrically conductive.

8. The fiber product of claim 1 which is derived from an aromatic polyamide fiber.

9. A fiber product comprising:

a core of a flexible, electroconductive carbonaceous fiber derived from a stabilized polymeric non-linear carbonaceous fiber precursor material, said fiber having a diameter of 4 to about 20 micrometers, a capability of repeatedly deflecting under load either by elongation or compression such that the fiber spring structure recovers its initial shape configuration when unloaded, an aspect ratio greater than 10:1, and a reversible deflection ratio of greater than about 1.2:1; and said fiber having a non-electrically conductive fluorinated surface thereon.

10. The fiber product of claim 9 wherein said carbonaceous fiber is derived from an acrylic based fiber.

11. The fiber product of claim 9 wherein said carbonaceous fiber is derived from an aromatic polyamide.

12. The fiber product of claim 9 wherein said carbonaceous fiber is electrically conductive.

* * * * *